US007442010B2

(12) United States Patent
Gruber et al.

(10) Patent No.: US 7,442,010 B2
(45) Date of Patent: Oct. 28, 2008

(54) IMPELLER, IN PARTICULAR FOR AN AXIAL FAN

(75) Inventors: Erhard Gruber, Satteldorf (DE); Reinhard (FH) Strohmeier, Roth Am See (DE); Otmar Huegel, Kuenzelsau (DE)

(73) Assignee: EBM-PAPST Mulfingen GmbH & Co. KG, Bachmuhle (DE)

( * ) Notice: Subject to any disclaimer, the term of this patent is extended or adjusted under 35 U.S.C. 154(b) by 531 days.

(21) Appl. No.: 11/154,781

(22) Filed: Jun. 15, 2005

(65) Prior Publication Data

US 2005/0287005 A1 Dec. 29, 2005

(30) Foreign Application Priority Data

Jun. 25, 2004 (DE) ..... 20 2004 010 088 U

(51) Int. Cl.
*F04D 29/38* (2006.01)

(52) U.S. Cl. ..... 416/169 A; 416/229 R; 416/234; 416/241 A

(58) Field of Classification Search ..... 416/169 A, 416/241 A, 229 R, 230, 234
See application file for complete search history.

(56) References Cited

U.S. PATENT DOCUMENTS

| | | | | |
|---|---|---|---|---|
| 2,801,793 | A * | 8/1957 | Kline | 416/93 R |
| 4,292,001 | A * | 9/1981 | Snell | 403/359.5 |
| 4,698,542 | A * | 10/1987 | Muller | 310/67 R |
| 5,574,321 | A * | 11/1996 | Baker | 310/67 R |
| 6,024,543 | A * | 2/2000 | Lambertson | 417/366 |
| 6,830,434 | B2 * | 12/2004 | Kondo et al. | 416/169 A |
| 2004/0075356 | A1 | 4/2004 | Horng et al. | |

FOREIGN PATENT DOCUMENTS

| | | |
|---|---|---|
| DE | 198 21 833 A1 | 11/1999 |
| DE | 200 13 697 U1 | 12/2000 |
| DE | 203 16 311 U1 | 2/2004 |

* cited by examiner

*Primary Examiner*—Igor Kershteyn
(74) *Attorney, Agent, or Firm*—Brinks Hofer Gilson & Lione

(57) ABSTRACT

An impeller for an axial fan of the type adapted to be pressed onto a rotating rotor comprising a number of blades. The blades protrude radially outward from a substantially tubular hub, which carries the blades and is adapted to be pressed onto the rotating rotor. A substantially cylindrical blank is arranged inside the hub where the blank forms alternately arranged first and second portions. The first portions have a greater inside diameter than the inside diameter of the second portions.

8 Claims, 5 Drawing Sheets

IMPELLER, IN PARTICULAR FOR AN AXIAL FAN

CROSS REFERENCE TO RELATED APPLICATION

This application claims priority to German patent application number 20 2004 010 088.6, filed Jun. 25, 2004 which is currently pending

FIELD OF THE INVENTION

The invention relates to an impeller, and in particular to an axial fan. The fan has an impeller body, with a number of blades protruding radially outward. A substantially tubular hub, which carries the blades can be pressed onto a rotating part, such as a rotor, a substantially cylindrical blank being arranged inside the hub.

BACKGROUND OF THE INVENTION

Axial fan impellers having an impeller body with a number of outwardly protruding blades and a hub which carries the blades and can be fastened on the rotor of an external-rotor motor are generally known.

Also known are axial fan impellers of the type described above in which the hub is formed in a tubular manner and can be pressed onto the rotor for fastening. These fans further include a plastic-encapsulated, substantially cylindrical, metallic blank being arranged inside the hub and circumferentially enclosing the rotor of the external-rotor motor. The cylindrically shaped steel blank of the known plastic impellers is expanded during the pressing-on operation. This expansion may cause high mechanical stresses in the hub, which can cause the impeller to break. Further disadvantages are that it is not possible for condensation that may form in the hub in cases where the temperature drops below the dew point to run off and that the plastic hub hinders the heat dissipation via the surface of the rotor.

The invention is based on the object of providing an impeller of the type previously described with greater mechanical stability in such a way that it can be produced with little technical complexity. In particular an impeller of this invention allows mechanical stresses in the hub arising as a result of the operation of pressing it onto a rotor shaft to be reduced.

This object is achieved according to the invention by the blank having alternately arranged first and second portions, the first portion having a greater inside diameter than the inside diameter of the second portion.

Consequently, a segmented metallic blank, in particular a steel blank, is preferably used according to the invention, "segmented" being understood as meaning that the cylindrical part of the blank is subdivided into portions with different inside diameters. The portion with the smaller diameter is widened during the pressing-on operation, while the portions with the large segment diameter do not change their radial position, or only slightly, during the pressing-on operation, but advantageously bring about a lowering of the average level of the mechanical stress.

While in the region of the greater diameter, where only a slight deformation occurs during assembly, the hub may, in a preferred configuration of the invention, be joined to the blank by means of webs, for the purpose of providing high mechanical stability. A plastic encapsulation of the blank may be formed in such a way that pockets are incorporated in the hub preferably in the region of the small diameter. In this way, the deformation of the blank occurring during pressing-on is not imposed on to the hub.

The pockets in the hub may in this case also be advantageously formed continuously in the axial direction, so that a connection is established between the suction side and the pressure side of the fan. As a result, two further advantages are also achieved. Specifically, a runoff of condensation possibly forming is made possible and an air flow occurs between the suction side and the pressure side through the pockets improving the cooling of the rotor.

BRIEF DESCRIPTION OF THE DRAWINGS

Further advantageous configurations of the invention are contained in the subclaims and the description which follows. The invention is explained in more detail on the basis of an exemplary embodiment represented in the accompanying figures of the drawing, in which:

DETAILED DESCRIPTION OF THE INVENTION

Figure 1:
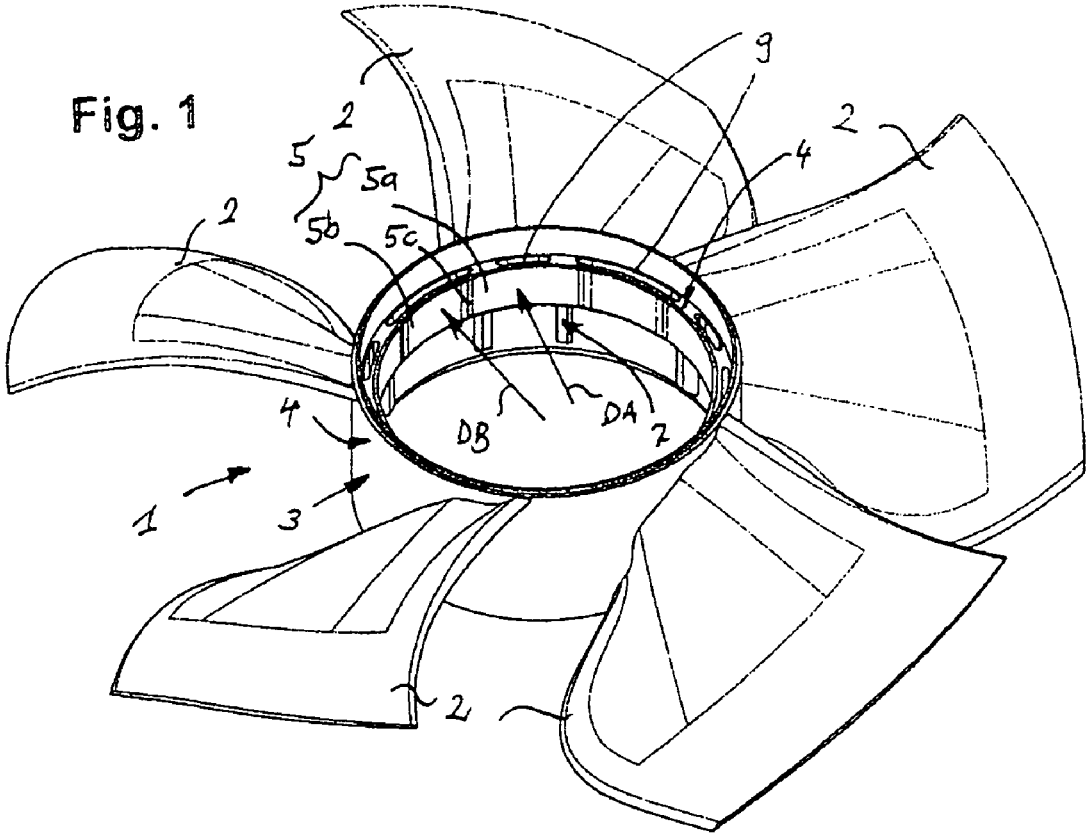
FIG. 1 shows a perspective representation of an impeller according to the invention.
Figure 2:
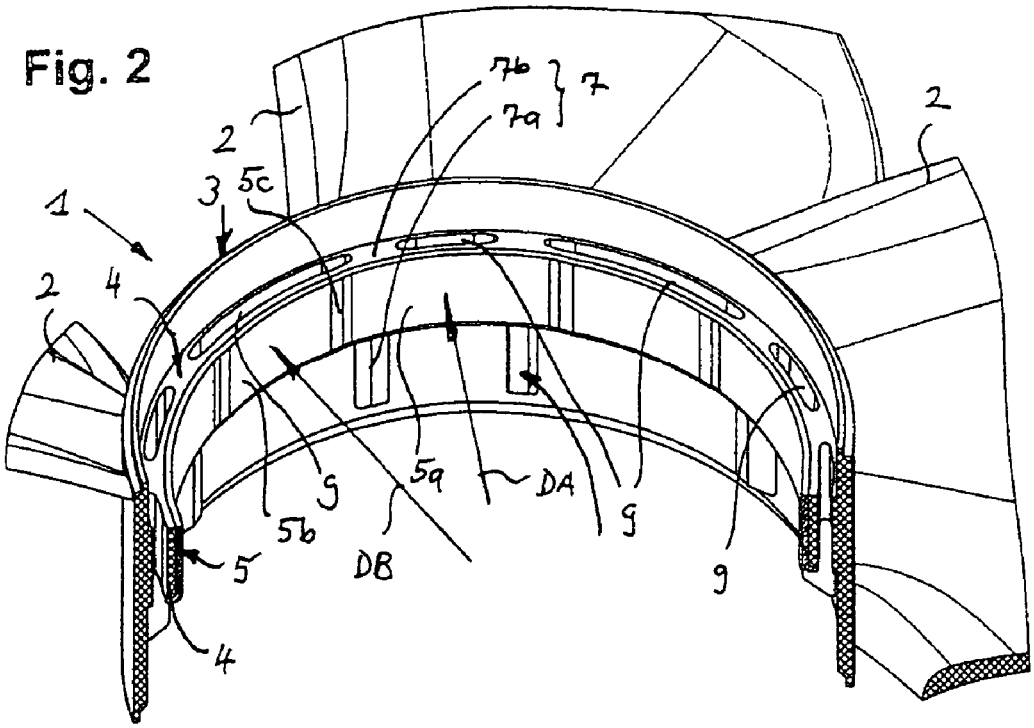
FIG. 2 shows a perspective representation of the impeller according to the invention that is represented in FIG. 1, but in axial section.
Figure 5:
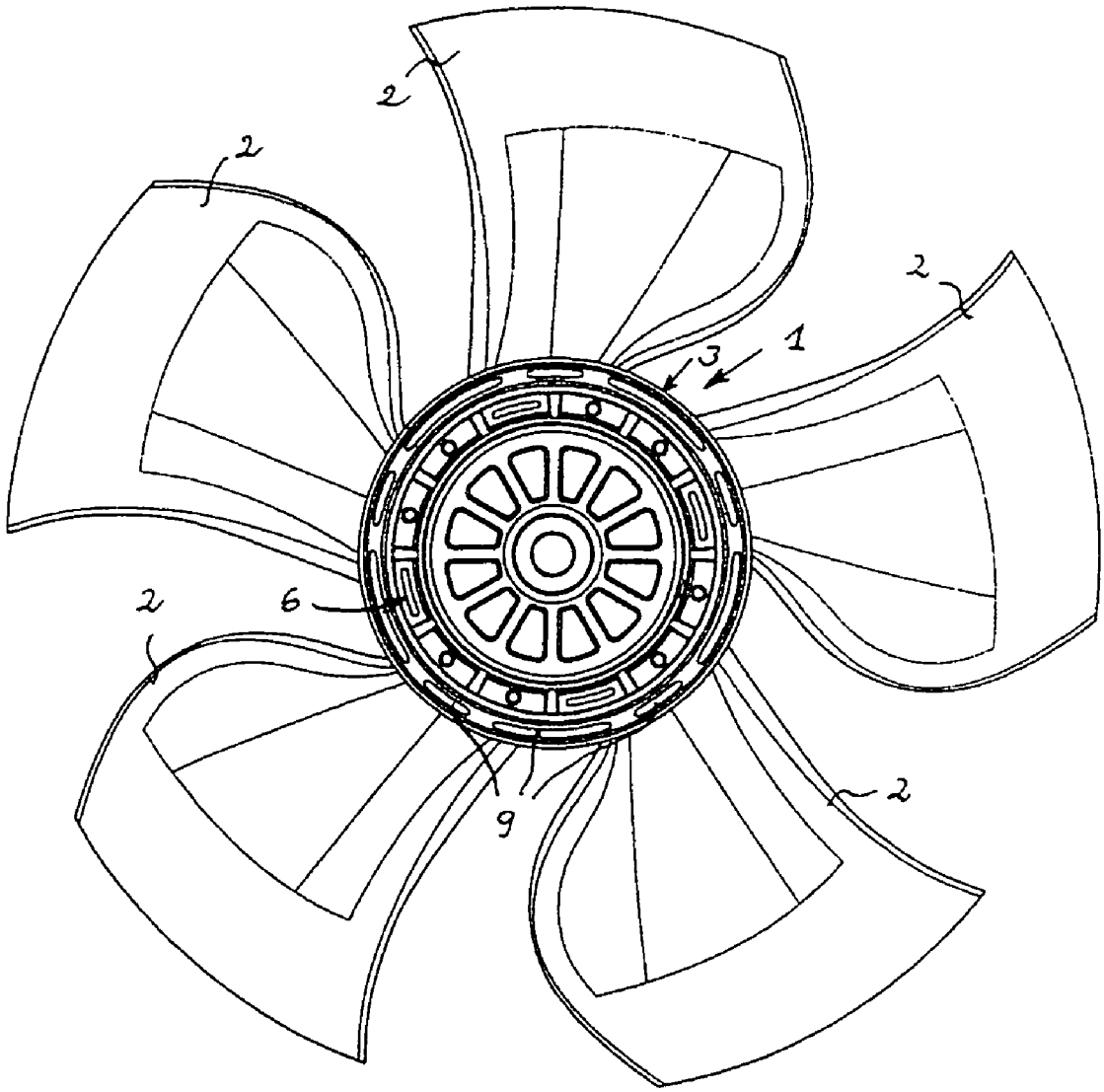
FIG. 5 shows a plan view of the impeller according to the invention that is represented in FIG. 1 in the mounted state.
Figure 6:
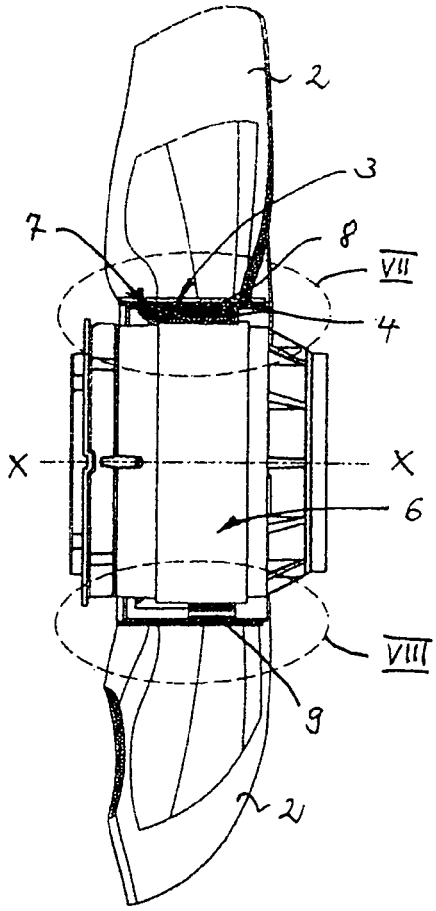
FIG. 6 shows an axially sectioned side view of an impeller according to the invention in the mounted state.
Figure 7:
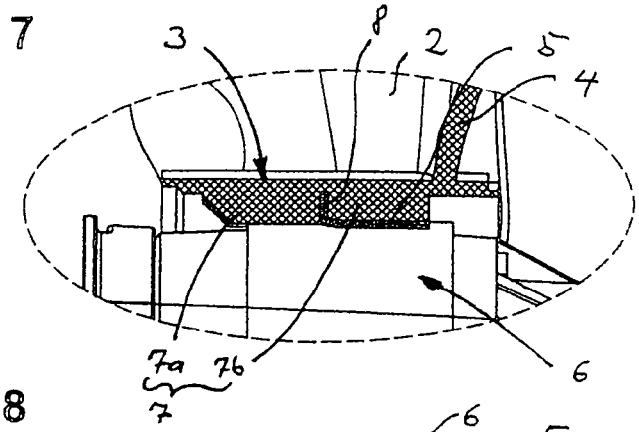
FIGS. 7 and 8 show enlarged representations of the detail of the impeller according to the invention that is denoted in FIG. 6 by VII and VIII.
Figure 8:
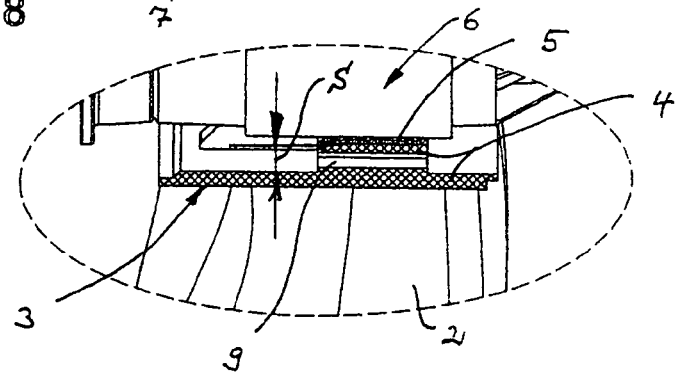
Figure 9:
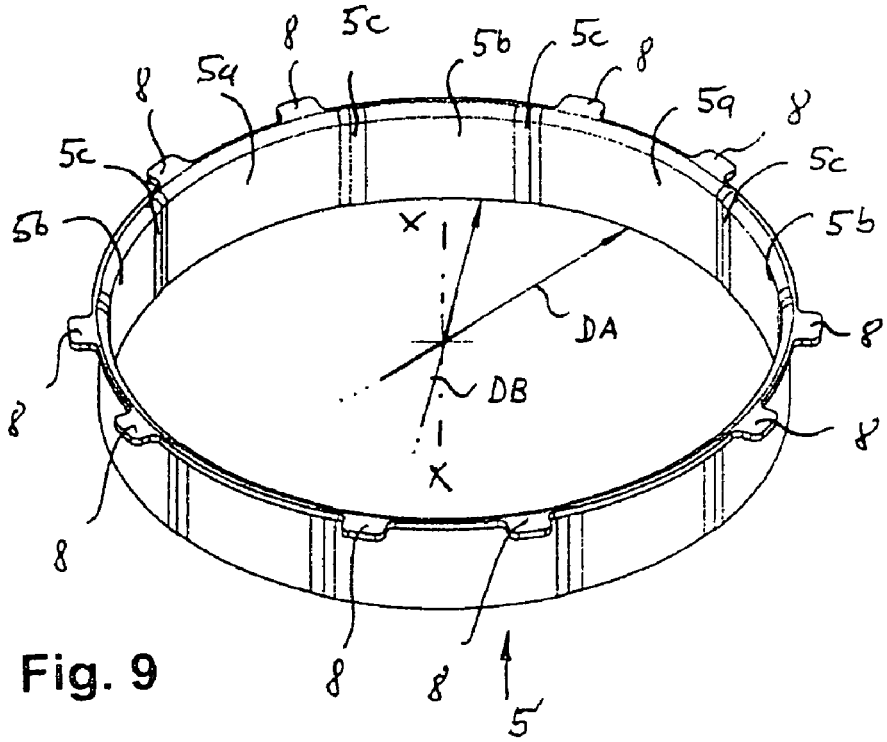
FIG. 9 shows a perspective representation of a blank of an impeller according to the invention.
Figure 10:
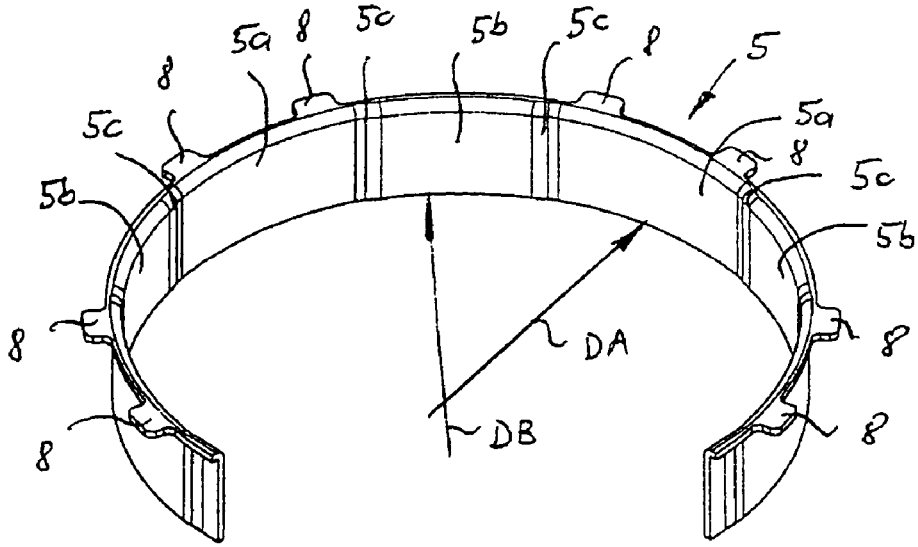
FIG. 10 shows a perspective representation of the blank used according to the invention that is represented in FIG. 9, but in partial section. In the figures of the drawing, the same parts are also always provided with the same designations, so that they are also generally described only once in each case.

As FIGS. 1 and 2 firstly show, an impeller according to the invention has an impeller body 1, which comprises a number of blades 2, protruding radially outward, and also a substantially tubular hub 3, carrying the blades 2. Arranged inside the hub 3 is a substantially cylindrical, metallic blank 5, which is surrounded by a plastic encapsulation 4 and in FIGS. 9 and 10 is represented as a single part. As FIG. 5 and also FIGS. 6 to 8 illustrate, the impeller body 1 can be fastened on a rotor 6 of a motor and forms an axial fan, in that the hub 3 is pressed onto the rotor 6 of the motor. The metallic blank 5 is in this case held in a fastening manner in the hub 3 by the plastic encapsulation 4 surrounding it.

According to the invention, it is provided that the blank 5 comprises alternately arranged first and second portions 5*a* and 5*b*, the first portions 5*a* having a greater inside diameter DA than the inside diameter DB of the second portions 5*b*. Respectively arranged between the first portions 5*a* and the second portions 5*b* are transitional portions 5*c*, in which the greater inside diameter DA goes over into the smaller inside diameter DB. This segmentation of the blank 5, which can be seen particularly clearly in FIGS. 9 and 10, which show the blank 5 as a single part, has the effect after the pressing onto the rotor 6 of the motor of achieving a reduction in or more uniform distribution of the mechanical stresses in the hub 3, leading to increased mechanical stability. The transitional portions 5*c* in this case prevent abrupt changes in the mechanical stresses in the blank 5.

Figure 3:
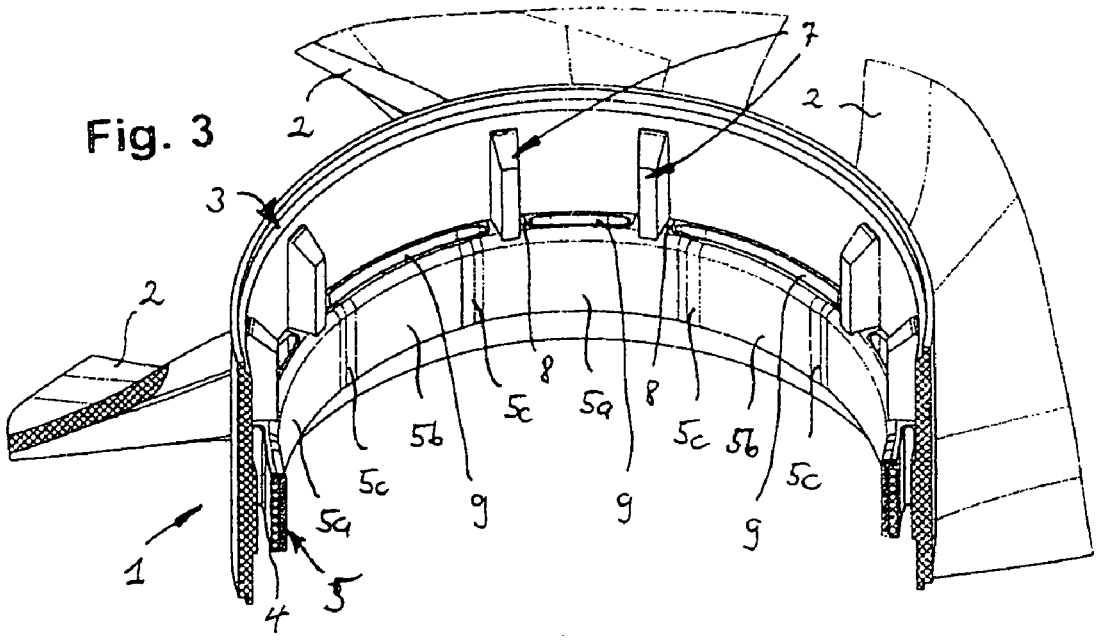
FIG. 3 shows a sectional representation corresponding to FIG. 2, but in a perspective representation in a view turned 180° with respect to FIG. 2.
Figure 4:
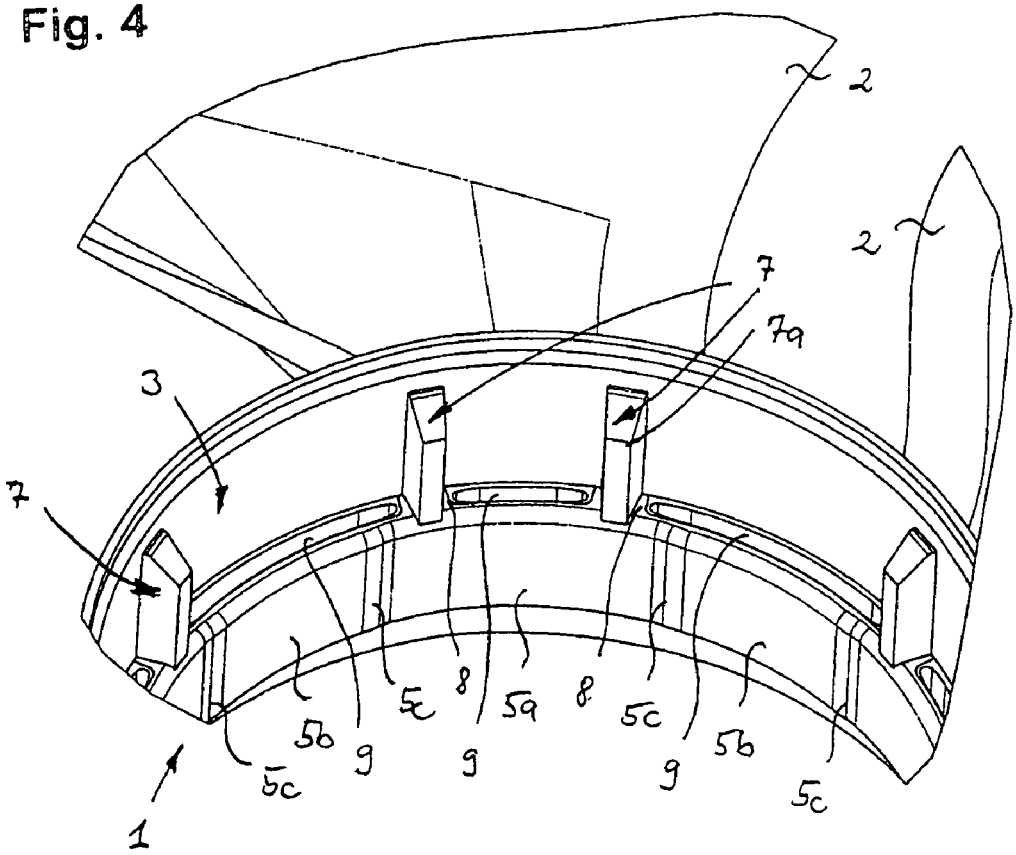
FIG. 4 shows an enlarged representation of a cutout from FIG. 3.

FIG. 3 and in an enlarged representation FIG. 4 show that, the blank 5 particularly in the region of the portions 5*a* with the greater inside diameters DA, can be joined to the hub 3 by means of webs 7, preferably by means of webs 7 running parallel to a longitudinal axis X-X (only represented in FIGS. 6 and 9). For this purpose, the blank 5 may correspondingly have, particularly in the region of the portions 5*a* with the greater inside diameters DA, radially outwardly protruding lugs 8 distributed over its annular circumference. The configuration of these lugs 8 on the blank 5 is illustrated in particularly FIGS. 9 and 10, and further in FIGS. 3 and 4, and in section in FIGS. 6 and 7. These figures show how the lugs 8 can preferably be connected to the hub 3. Preferably, the lugs 8 of the blank 5 are embedded in the plastic encapsulation 4 with a form fit and material bond. The embedding advantageously provides high stability in the region of the webs 7, which are integrally formed with the hub 3.

The webs 7 comprise a first web portion 7*a* and a second web portion 7*b*, with portion 7*b* being located in the region of the plastic encapsulation 4 or in particular forming a component part of the plastic encapsulation 4, which encloses the blank 5 along its entire outer lateral surface in the manner of a collar. The first web portion 7*a* is located in a region of the hub 3 in which the hub is set back radially outward with respect to the lateral surface of the blank 5, which is indicated by the spacing denoted in FIG. 8 by the designation S. As FIG. 7 shows, in this case the lugs 8 preferably form the limit in each case between the first web portion 7*a* and the second web portion 7*b*. The first web portion 7*a* increases the size of the joining surface area on the hub and consequently brings about increased stability.

A further advantage of the invention is that pockets 9, preferably with a slot-like outline, can be incorporated in the hub 3, which pockets are circumferentially arranged in the plastic encapsulation 4, in particular in the region of the small diameter DB of the blank 5. The deformation of the blank 5 occurring during the pressing-on is absorbed by a deformation of the pocket walls that are lying against the blank and are not denoted any more specifically, and is not passed on to the remaining body of the hub 3.

Virtually all the figures of the drawing (apart from FIGS. 7, 9 and 10) show, however, that the pockets 9 may also extend in the plastic encapsulation 4 in the region of the large diameter DA of the blank 5. However, the walls lying circumferentially between the pockets 9 are in this case preferably formed by the second web portions 7*b*, described above and lying in the plastic encapsulation 4 in the region of the large diameter DA, ensuring that the surface pressure between the plastic encapsulation 4 and the blank 5 is adequate and that no delamination of the plastic encapsulation 4 from the blank 5 is caused by the deformation of the pockets 9.

It may preferably be provided that the pockets 9 in the hub 3 are formed continuously in the axial direction. As already mentioned, the resultant apertures in the hub region advantageously make it possible for cooling air to flow around the rotor 6 and for condensation forming when the temperature drops below the dew point to run off. To this extent, the presence or described formation of the pockets 9 is attributed independent inventive significance.

As evident from the above description, the present invention is not restricted to the exemplary embodiments represented, but includes all means and measures that have the same effect in the sense of the invention. For example, the segmentation of the blank that is provided according to the invention is not confined to a specific type of motor, such as an external-rotor type, or a specific configuration of the blades 2 located on the hub 3. Furthermore, it is also within the scope of the present invention if the blank 5 is not, as described, fastened in the hub 3 by means of the lugs 8 with a material bond, but for example by a force closure and/or form fit, i.e. for example a latching engagement of the blank 5 may be provided.

As a person skilled in the art will readily appreciate, the above description is meant as an illustration of implementation of the principles this invention. This description is not intended to limit the scope or application of this invention in that the invention is susceptible to modification, variation and change, without departing from the spirit of this invention, as defined in the following claims.

The invention claimed is:

1. An impeller for an axial fan of the type adapted to be pressed onto a rotating rotor, comprising a number of blades, protruding radially outward from a substantially tubular hub, which carries the blades and is adapted to be pressed onto the rotating rotor, a substantially cylindrical blank being arranged inside the hub, wherein the blank forms alternately arranged first and second portions, the first portions having a greater inside diameter than the inside diameter of the second portions, and wherein the blank is formed of metal and is surrounded by a plastic encapsulation wherein the blank has radially outwardly protruding lugs in the region of the first portions, wherein the blank in regions of the first portions is joined to the hub by means of webs, wherein the lugs of the blank are embedded in the plastic encapsulation with a form fit and material bond, in the region of the webs.

2. The impeller as claimed in claim 1, wherein arranged between the first portions and the second portions are transitional portions.

3. The impeller as claimed in one of claim 1, wherein the blank in regions of the first portions is joined to the hub by means of webs, the webs running parallel to a longitudinal axis of the impeller body and integrally formed with the hub.

4. The impeller as claimed in one of claim 1, wherein the blank has in the region of the portions with the greater inside diameters, radially outwardly protruding lugs in the region of the first portions.

5. The impeller as claimed in claim 1, wherein the blank has in the region of the portions with the greater inside diameters, radially outwardly protruding lugs in the region of the first portions, wherein the blank in regions of the first portions is joined to the hub by means of webs, the webs running parallel to a longitudinal axis of the impeller body and integrally formed with the hub, wherein the lugs of the blank are embedded in the plastic encapsulation with a form fit and material bond, in the region of the webs.

6. An impeller for an axial fan of the type adapted to be pressed onto a rotating rotor, comprising a number of blades, protruding radially outward from a substantially tubular hub, which carries the blades and is adapted to be pressed onto the rotating rotor, a substantially cylindrical blank being arranged inside the hub, wherein the blank forms alternately arranged first and second portions, the first portions having a greater inside diameter than the inside diameter of the second portions wherein pockets are incorporated in the hub, which pockets are arranged in the plastic encapsulation in the region of the first portions of the blank.

7. An impeller for an axial fan of the type adapted to be pressed onto a rotating rotor, comprising a number of blades, protruding radially outward from a substantially tubular hub, which carries the blades and is adapted to be pressed onto the rotating rotor, a substantially cylindrical blank being arranged inside the hub, wherein the blank forms alternately arranged first and second portions, the first portions having a greater inside diameter than the inside diameter of the second portions, wherein pockets are incorporated in the hub, which pockets are arranged in the plastic encapsulation in the region of the first portions of the blank, and wherein the pockets in the hub are formed continuously in the axial direction.

8. An impeller for an axial fan of the type adapted to be pressed onto a rotating rotor, comprising a number of blades, protruding radially outward from a substantially tubular hub, which carries the blades and is adapted to be pressed onto the rotating rotor, a substantially cylindrical blank being arranged inside the hub, wherein the blank forms alternately arranged first and second portions, the first portions having a greater inside diameter than the inside diameter of the second portions, wherein pockets are incorporated in the hub, which pockets are arranged in the plastic encapsulation in the region of the first portions of the blank, and wherein the pockets are formed in a slot-like manner in outline and are circumferentially separated from one another by a web portion of the webs joining the blank to the hub.

* * * * *